US007461872B2

(12) United States Patent
Moon et al.

(10) Patent No.: US 7,461,872 B2
(45) Date of Patent: Dec. 9, 2008

(54) MOTORIZED SWING BOLT LOCK

(75) Inventors: Charles W. Moon, Colorado Springs, CO (US); Michael J. Wright, Santa Ana, CA (US)

(73) Assignee: Computerized Security Systems, Inc., Troy, MI (US)

( * ) Notice: Subject to any disclaimer, the term of this patent is extended or adjusted under 35 U.S.C. 154(b) by 13 days.

(21) Appl. No.: 11/521,201

(22) Filed: Sep. 14, 2006

(65) Prior Publication Data

US 2007/0252394 A1 Nov. 1, 2007

Related U.S. Application Data

(60) Provisional application No. 60/791,386, filed on Apr. 12, 2006.

(51) Int. Cl.
*E05C 3/04* (2006.01)

(52) U.S. Cl. ..... 292/209; 292/109

(58) Field of Classification Search ..... 292/201, 292/341.16; 70/277, 279.1
See application file for complete search history.

(56) References Cited

U.S. PATENT DOCUMENTS

| | | | | |
|---|---|---|---|---|
| 4,597,598 | A * | 7/1986 | Bascou | 292/68 |
| 4,978,153 | A * | 12/1990 | Hirsch et al. | 292/201 |
| 6,139,073 | A * | 10/2000 | Heffner et al. | 292/201 |
| 6,786,519 | B2 * | 9/2004 | Gartner | 292/195 |
| 2004/0113433 | A1 * | 6/2004 | Marzolf et al. | 292/201 |

* cited by examiner

*Primary Examiner*—Gary Estremsky
(74) *Attorney, Agent, or Firm*—Carlson, Gaskey & Olds

(57) ABSTRACT

A lock mechanism includes a torsion bar that prevents movement of a slide bar abutting a swing bolt. The torsion bar engages the swing bar in a direction transverse to sliding movement to prevent undesired movement away from abutting contact with the swing bolt.

13 Claims, 4 Drawing Sheets

MOTORIZED SWING BOLT LOCK

CROSS REFERENCE TO RELATED APPLICATION

The application claims priority to U.S. Provisional Application No. 60/791,386 which was filed on Apr. 12, 2006.

BACKGROUND OF THE INVENTION

This invention generally relates to a swing bolt lock. More particularly, this invention relates to a locking and unlocking mechanism for a swing bolt lock.

Doors of safes, vaults or other security enclosures include a bolt that moves from a locked to a non-locked position responsive to a lock mechanism. A swing bolt locking device includes a substantially D-shaped bolt that rotates about a pivot. The D-shaped bolt includes an abutment that contacts a slide bar. The slide bar is typically locked in a position that prevents movement of the D-shaped bolt to provide a desired locked condition. The slide bar is typically locked by a pin that is movable through an opening by a solenoid. Energizing the solenoid retracts the pin and allows movement of the slide bar that in turn allows unlocking of the D-shaped bolt.

Disadvantageously, linear movement of the locking pin can be susceptible to external shocks and vibrations that can cause undesired retraction of the locking pin.

Accordingly, it is desirable to design and develop a locking device that is not susceptible to defeat by external forces.

SUMMARY OF THE INVENTION

An example lock mechanism includes a torsion bar that prevents movement of a slide bar abutting a swing bolt. The torsion bar engages the swing bar in a direction transverse to sliding movement to prevent undesired movement away from abutting contact with the swing bolt.

The slide bar is biased into engagement with the swing bolt by a biasing spring and is movable linearly away from the swing bolt to allow rotation of the swing bolt to an unlocked position. Attempted rotation of the swing bolt with the slide bar engaged causes linear movement of the swing bolt substantially parallel with the bias spring such that a hook of the swing bolt engages a surface of the housing that prevents rotation.

The slide bar is retained in a locked position by the torsion member. An arm of the torsion member is biased upwardly to engage a tab of the slide bar. Engagement with the tab prevents linear movement of the slide bar.

The arm is engaged to a clutch driven by an electric motor. The clutch includes an eccentric outer portion that moves the arm downwardly to release the slide bar and allow linear movement responsive to rotation of the swing bolt. Bias in the torsion member provided by the securement of the leg prevents jolts or shocks from freeing the slide bar from the locked position.

Accordingly, the example lock mechanism provides the desired securement of the swing bolt in a mechanism that is not defeatable by vibrations, shocks or jolts and that provides protection to the electric motor.

These and other features of the present invention can be best understood from the following specification and drawings, the following of which is a brief description.

DETAILED DESCRIPTION OF AN EXAMPLE EMBODIMENT

Figure 1:
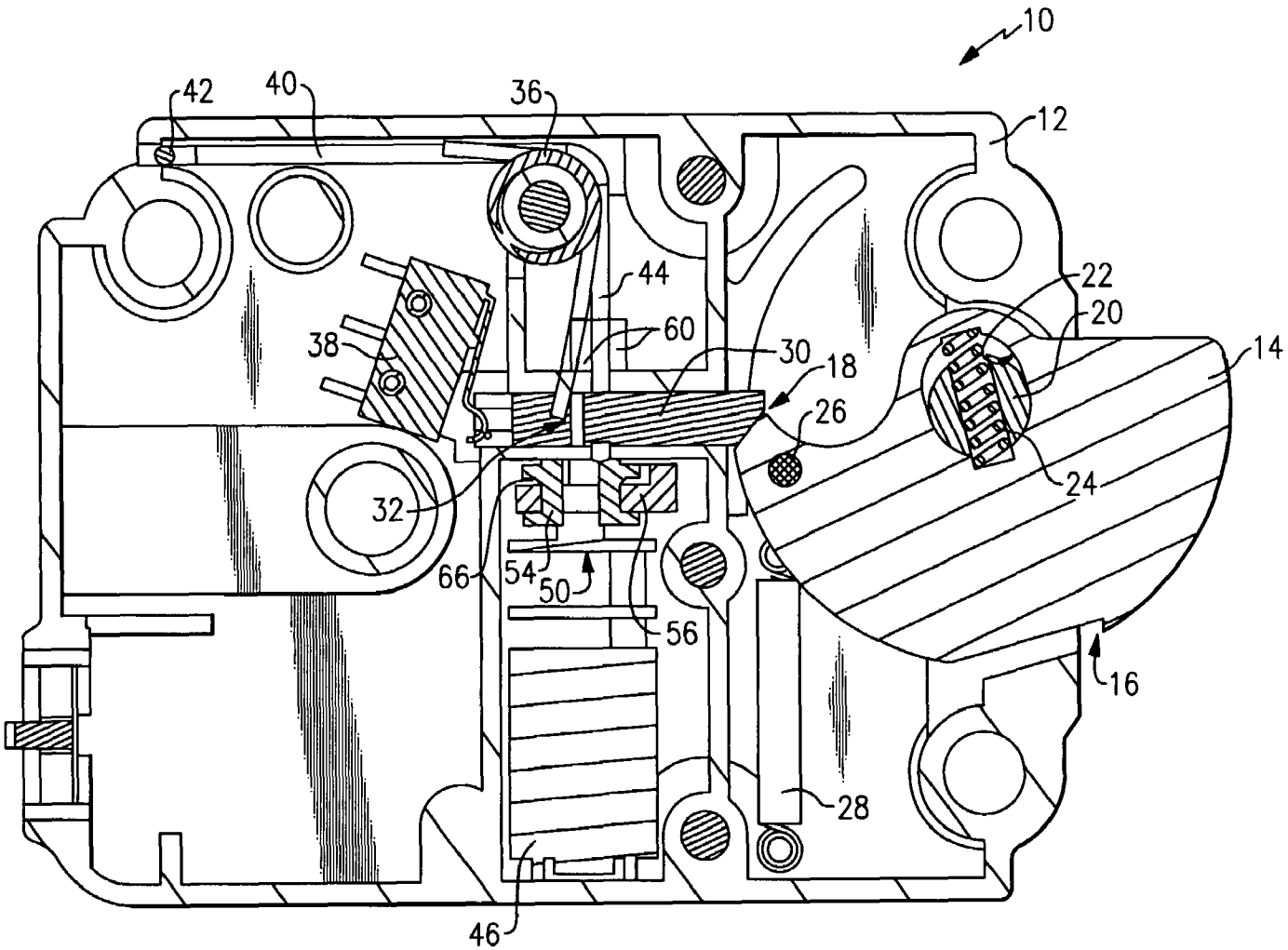
FIG. 1 is a top view of an example lock mechanism of this invention.

Referring to FIG. 1, an example lock mechanism 10 includes a housing 12 that supports rotation of a swing bolt 14 about a pivot pin 20. The swing bolt 14 includes an eccentric opening 22 within which pivot pin 20 is disposed. The eccentric opening 22 provides for linear movement of the swing bolt 14 in a direction parallel with a bias spring 24. The bias spring 24 biases the swing bolt 14 to provide rotary motion of the swing bolt 14 about the pivot pin 20 when released from a locked position.

The swing bolt 14 includes an abutment 18 that engages a slide bar 30. The slide bar 30 is biased into engagement with the swing bolt 14 by biasing spring 36. The slide bar 30 is movable linearly away from the swing bolt 14 to allow rotation of the swing bolt 14 to an unlocked position. Attempted rotation of the swing bolt 14 with the slide bar 30 engaged causes linear movement of the swing bolt 14 substantially parallel with the bias spring 24 such that a hook 16 of the swing bolt 14 engages a surface of the housing 12 that prevents rotation. The hook 16 engages the housing 12 and provides a positive stop that prevents transmission of forces to the internal locking mechanism.

The swing bolt 14 is biased toward the locked position by an extension spring 28. The extension spring 28 is attached at one end to the housing 12 and at another end to retention pin 26 fixed to the swing bolt 14. Accordingly, the swing bolt 14 is biased toward the locked condition, and the slide bar 30 is biased to engage the abutment 18.

Figure 2:
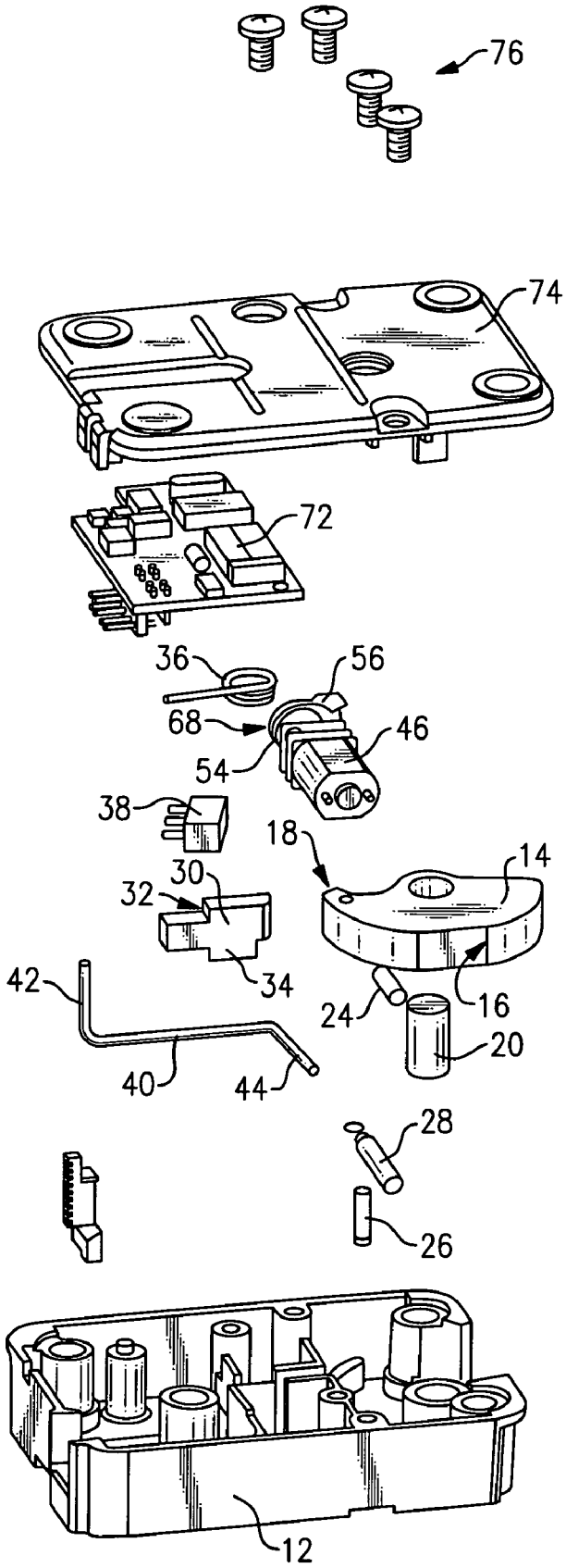
FIG. 2 is an exploded view of the example lock mechanism.

Referring to FIG. 2 with continuing reference to FIG. 1, the slide bar 30 is biased toward engagement with the swing bolt 14 by the biasing spring 36. The biasing spring 36 is biased against a top tab 32 of the slide bar 30.

The slide bar 30 is retained in a locked position by a torsion member 40. The torsion member 40 includes a leg 42 on a first end that is held in a vertical position within the housing 12. A second end of the torsion member 40 includes an arm 44.

The lock mechanism 10 includes a circuit 72 for electrical communication to external controls and that also provides for control of the electric motor 46. The circuit 72 is provided with those components required to effect control and communication with the switch 38 and electric motor 46. A cover 74 attaches to the housing 12 by way of a plurality of fasteners 76.

Figure 3:
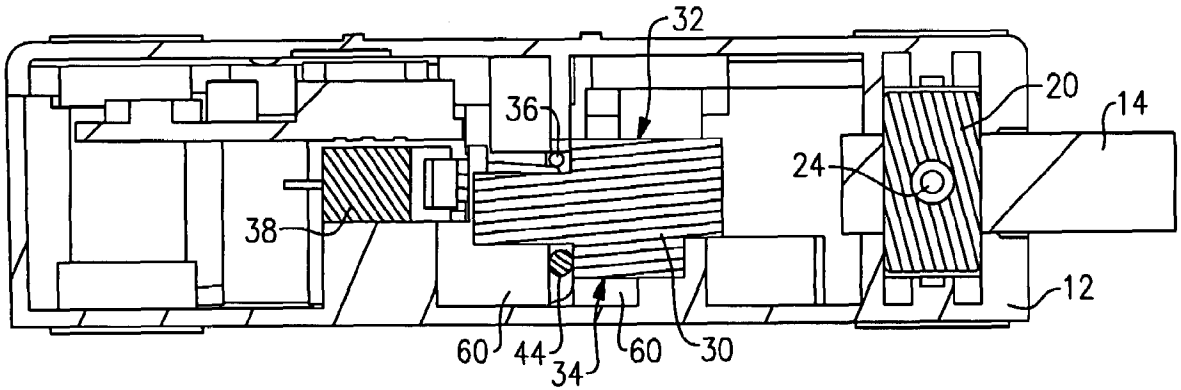
FIG. 3 is a cross-section of the example lock mechanism.

Referring to FIG. 3, the arm 44 is biased upwardly under the slide bar 30 to engage a side of bottom tab 34. Energy stored in the arm 44 of the torsion member 40 continually biases the arm 44 upwardly against the slide bar 30. Engagement with the bottom tab 34 substantially prevents linear movement of the slide bar 30. The arm 44 is held in a desired position by flanges 60 of the housing 12. The housing flanges 60 align the arm 44 in the desired position and also prevent sliding movement to lock the sliding bar 30 in the desired position.

Figure 4A:
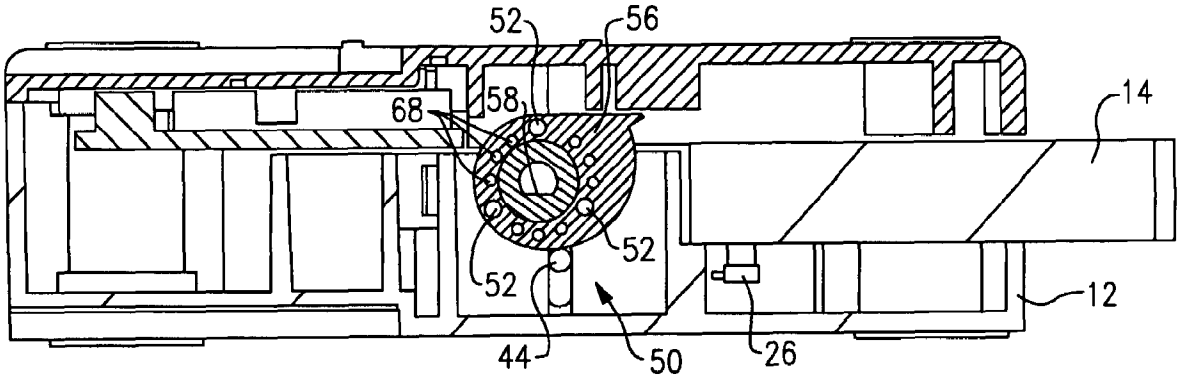
FIG. 4A is another cross-section of the example lock mechanism in a locked position.
Figure 4B:
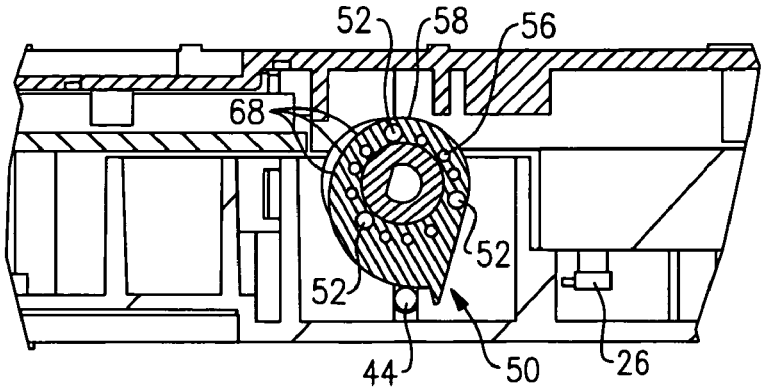
FIG. 4B is another cross-section of the example lock mechanism in an unlocked position.

Referring to FIGS. 4A and 4B, the arm 44 includes an end that engages a clutch 50. The clutch 50 is rotated by an electric motor 46. The clutch 50 includes an eccentric outer portion 56 that moves the arm 44 downwardly when rotated in a desired direction by the electric motor 46 (FIG. 4B). The downward movement of the arm 44 releases the slide bar 30 and allows linear movement responsive to rotation of the swing bolt 14. Bias in the torsion member 44 provided by the securement of the leg 42 prevents jolts or shocks from freeing the slide bar 30 from the locked position.

Rotation of the electric motor 46 in a direction opposite that direction utilized to push the arm 44 downward provides for re-engagement of the arm 44 with the tab 34 to block sliding movement of the slide bar 30 and thereby return the lock mechanism 10 to a locked condition.

Figure 5:
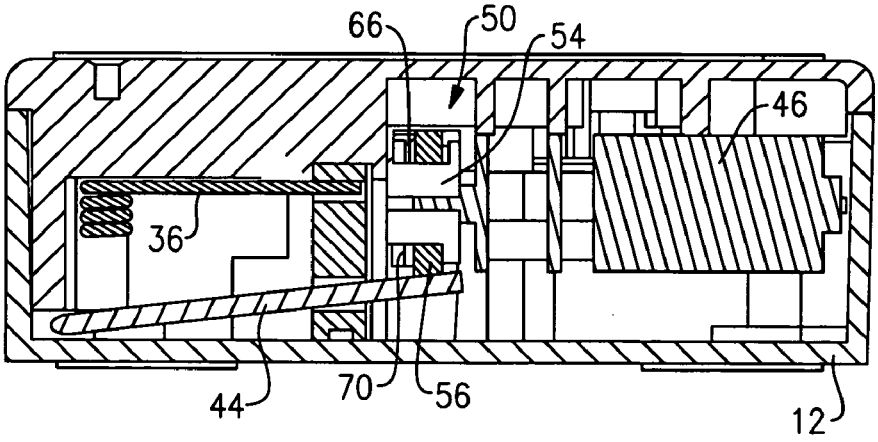
FIG. 5 is another cross-section of the example lock mechanism.

Referring now also to FIG. 5, with continuing reference to FIGS. 4A and 4B, the clutch 50 includes an inner clutch portion 54 disposed within the outer clutch portion 56. The example inner clutch portion 54 is fabricated from a powdered metal material and the example outer clutch portion 56 is fabricated from a plastic material. The inner clutch portion 54 includes a D-shaped opening 58 for a shaft of the electric motor 46. Rotation of the electric motor 46 rotates the inner clutch portion 54. Disposed between the inner clutch portion 54 and the outer clutch portion 56 are three clutch balls 52 engaged to three of twelve detents 68 disposed on the inner clutch portions 54. A biasing force is provided by a spring washer 66 that is held in place by a retention washer 70.

Rotation of the inner clutch portion 54 is transmitted through the clutch balls 52 to the outer clutch portion 56. In the event that a binding force is present that is biased against rotation of the clutch 50, the clutch balls 52 will overcome the retaining force provided by the spring washer 66 and push out of the detent 68 in which the clutch ball 52 is currently disposed, thereby preventing transmission of rotational movement to the outer clutch portion 56. The clutch ball 52 will continue to move from detent 68 to detent 68 until the forces disposed against rotation fall below the force exerted by the spring washer 66. In this way, the clutch 50 isolates the electric motor 46 from excessive torque and possibly damage.

In operation, the lock mechanism 10 begins in a default position with the slide bar 30 engaged with the abutment 18 of the swing bolt 14. Any external force exerted to attempt rotation of the swing bolt 14 will result in linear movement in a direction parallel with the bias spring 24 to cause abutment of the hook 16 with a side of the housing 12. This engagement prevents rotation of the swing bolt 14 without transmitting the load onto internal components of the lock mechanism.

The slide bar 30 is retained in the locked condition engaged with the swing bolt 14 by the arm 44 of the torsion member 40. Further, the slide bar 30 is biased by the bias spring 36 toward a position locking the swing bolt 14. Release of the slide bar 30 requires energizing the electric motor 46 to rotate the clutch 50 such that the outer clutch portion 56 having the eccentric shape pushes the arm 44 downward and free of the bottom tab 34. Any binding of the mechanism is isolated from the electric motor 46 by the clutch 50, such that the electric motor 46 is not attempting to rotate against excessive forces.

With the arm 44 moved downwardly, the slide bar 30 is free to slide toward an open position. The bias spring 36 exerts less of a biasing force than the biasing spring 24, such that the swing bolt 14 rotates about the pin 20 with substantially no linear component.

Movement of the slide bar 30 to an unlocked position will engage the switch 38 that in turn will signal that the lock mechanism is in an open condition. The signal from the switch 38 can be utilized by several systems to indicate and alert to the status of the lock mechanism 10.

The electric motor 46 will remain in the rotational position freeing the slide bar 30 for a desired time period and then rotate back to re-engage the arm 44. During the open period a handle or other device can be rotated to open the swing bolt 14. Once the swing bolt 14 is open and swung into the housing 12, the slide bar 30 will slide all the way to the open position. Release of the arm 44 with the slide bar 30 in this unlocked position results in the arm 44 contacting the tab 34 in such a matter as to not engage the slide bar 30 and prevent movement. The arm 44 will rest on a bottom surface of the tab 34 until movement of the slide bar 30 back to the locked position. Once the slide bar 30 is moved back to the locked position, the arm 44 will snap back into place and block sliding of the slide bar 30. As appreciated, such movement does not require actuation of the electric motor 46, as the torsion built into the torsion member 40 provides the necessary force and energy to return the arm 44 to a locked position.

Accordingly, the example lock mechanism 10 provides the desired securement of the swing bolt 14 in a mechanism that is not defeatable by vibrations, shocks or jolts and that provides protection to the electric motor. Further, the example lock mechanism 10 conserves energy by not requiring motor actuation to return to a locked condition.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A lock mechanism comprising:

a bolt movable between a locked and un-locked position;

a slide bar in abutting contact with the bolt to prevent movement of the bolt to the un-locked position;

a spring member moveable from an engaged position that prevents movement of the slide bar and a disengaged position that allows movement of the slide bar; and a drive in abutting contact with the spring member for moving the spring member between the engaged and disengaged positions, wherein the spring member comprises a torsion bar including an arm selectively abutting a tab of the slide bar, wherein the engaged position comprises the torsion bar abutted against the tab, and the disengaged position comprise the torsion bar removed from abutting contact with the tab.

2. The lock mechanism as recited in claim 1, wherein the torsion bar comprises a leg abutting a fixed structure for biasing the arm toward the engaged position.

3. The lock mechanism as recited in claim 1, including a second biasing member that biases the slide bar toward abutting contact with the bolt.

4. The lock mechanism as recited in claim 1, including a clutch driven by the drive against the torsion arm for moving the torsion arm from the engaged position to the disengaged position, wherein the clutch isolates the drive from excessive application of torque.

5. A lock mechanism comprising:

a bolt movable between a locked and un-locked position;

a slide bar in abutting contact with the bolt to prevent movement of the bolt to the un-locked position;

a first biasing member moveable from an engaged position that prevents movement of the slide bar and a disengaged position that allows movement of the slide bar; and a drive for moving the biasing member between the engaged and disengaged positions; and a clutch driven by the drive that isolates the drive from excessive application of torque, wherein the clutch comprises a first plate engaged for moving the biasing member between engaged and disengaged positions and a second plate driven by the drive and a ball disposed between the first and second plates for transmitting torque from the first plate to the second plate.

6. The lock mechanism as recited in claim 5, wherein the drive comprises an electric motor for rotating the second plate.

7. A lock mechanism comprising:

a bolt movable between a locked and un-locked position;

a slide bar in abutting contact with the bolt to prevent movement of the bolt to the un-locked position;

a spring member moveable from an engaged position that prevents movement of the slide bar and a disengaged position that allows movement of the slide bar; and a drive in abutting contact with the spring member for moving the spring member between the engaged and disengaged positions, wherein the spring member provides a biasing force in a direction transverse to movement of the slide bar and also provides a biasing force in a direction to move the slide bar into abutting contact with the bolt.

8. A lock mechanism comprising:

a bolt movable between a locked and un-locked position;

a slide bar in abutting contact with the bolt to prevent movement of the bolt to the un-locked position;

a spring member moveable from an engaged position that prevents movement of the slide bar and a disengaged position that allows movement of the slide bar; and a drive in abutting contact with the spring member for moving the spring member between the engaged and disengaged positions, wherein the bolt is mounted for rotation about a pivot.

9. A motorized swing bolt lock mechanism comprising:

a swing bolt rotatable about a pivot between a locked position and an unlocked position;

a slide bar biased against the swing bolt to prevent movement of the swing bolt from the locked position to the unlocked position;

a torsion member movable between an engaged position that prevents movement of the slide bar and a disengaged position that allows movement of the slide bar, wherein the torsion member comprises an arm that is biased into abutting contact with a tab on the slide bar in the engaged position and the arm exerts a biasing force in a first direction transverse to movement of the slide bar and in a second direction common with the direction of movement of the slide bar into abutting contact with the swing bolt ; and an electric motor for moving the torsion member between the engaged position and the disengaged position, wherein the arm is driven by the electric motor between the engaged position and the disengaged position.

10. The motorized swing bolt mechanism as recited in claim 9, including a clutch for selectively transmitting torque from the electric motor to the torsion member.

11. A lock mechanism comprising:

a bolt movable between a locked and un-locked position;

slide bar in abutting contact with the bolt to prevent movement of the bolt to the un-locked position;

a spring member moveable from an engaged position that prevents movement of the slide bar and a disengaged position that allows movement of the slide bar; and a drive in abutting contact with the spring member for moving the spring member between the engaged and disengaged positions, wherein the spring member extends across the slide bar in a first direction transverse to sliding movement of the slide bar, wherein movement of the spring member between the engaged and disengaged positions is in a second direction different than the first direction and also transverse to movement of the slide bar.

12. The lock mechanism as recited in claim 1, including flanges that hold the arm in alignment with the tab and prevent movement of the arm in the direction of the slide bar.

13. A motorized swing bolt lock mechanism comprising:

a swing bolt rotatable about a pivot between a locked position and an unlocked position;

a slide bar biased against the swing bolt to prevent movement of the swing bolt from the locked position to the unlocked position;

a torsion member movable between an engaged position that prevents movement of the slide bar and a disengaged position that allows movement of the slide bar; and an electric motor for moving the torsion member between the engaged position and the disengaged position, wherein the torsion member extends across the slide member in a direction transverse to movement of the slide member.

* * * * *

UNITED STATES PATENT AND TRADEMARK OFFICE

CERTIFICATE OF CORRECTION

PATENT NO. : 7,461,872 B2
APPLICATION NO. : 11/521201
DATED : December 9, 2008
INVENTOR(S) : Moon et al.

It is certified that error appears in the above-identified patent and that said Letters Patent is hereby corrected as shown below:

Claim 11, Column 6, line 17: insert --a-- before "slide"

Signed and Sealed this

Twenty-fourth Day of February, 2009

John Doll

JOHN DOLL
*Acting Director of the United States Patent and Trademark Office*